US006021971A

United States Patent [19]

Sheckler et al.

[11] Patent Number: 6,021,971

[45] Date of Patent: Feb. 8, 2000

[54] WINDING HEAD FOR WIRE COILS

[75] Inventors: Anthony E. Sheckler, Columbia City; Keith Edwards, Albion; Kevin L. Myers, Pierceton, all of Ind.

[73] Assignee: Dana Corporation, Toledo, Ohio

[21] Appl. No.: 09/163,482

[22] Filed: Sep. 30, 1998

[51] Int. Cl.[7] ..... B65H 54/10; B65H 54/24; B65H 54/547; B65H 75/24; B65H 75/28

[52] U.S. Cl. ..... 242/474.5; 242/472.6; 242/571.5; 242/573.9; 242/586.2; 242/597.4; 242/613.2

[58] Field of Search ..... 242/448, 472.6, 242/474.5, 439, 571.4, 571.5, 573.9, 586.2, 597.4, 597.2, 613.2; 140/71 C, 92.1, 92.2, 124

[56] References Cited

U.S. PATENT DOCUMENTS

| | | | |
|---|---|---|---|
| 1,172,910 | 2/1916 | Scott | 140/92.2 |
| 2,529,185 | 11/1950 | Proctor | 242/573.9 |
| 2,648,503 | 8/1953 | Revak et al. | 242/597.4 |
| 2,733,873 | 2/1956 | Petersen | 242/573.9 |
| 3,259,336 | 7/1966 | Hibbard . | |
| 4,121,627 | 10/1978 | Schmid . | |
| 4,416,057 | 11/1983 | Tardy . | |
| 4,422,591 | 12/1983 | Van Maanen | 242/573.9 |
| 4,538,771 | 9/1985 | Tardy . | |
| 4,613,092 | 9/1986 | Nakai et al. | 242/573.9 |
| 4,746,075 | 5/1988 | Hoxit | 242/472.6 |

*Primary Examiner*—John M. Jillions
*Attorney, Agent, or Firm*—Millen, White, Zelano & Branigan, P.C.

[57] ABSTRACT

In a coil winding machine, a unitary winding head is replaced by a winding head having a bobbin removably mounted on a mandrel. The bobbin has a cavity which receives a projecting portion of the mandrel in order to mount the bobbin on the mandrel. The bobbin is held in fixed relation on the mandrel with a plurality of screws which pass through holes through a hub at a first end of the bobbin and thread into axial bores in projecting portion of the mandrel. A plurality of segments separated by slots extend from the hub, each having a second end face which is convex at a slight angle and is aligned with a shoulder on the mandrel having a concave end face so as to urge the segments into engagement with the projecting portion of the mandrel as the screws are tightened in the axial bores in the mandrel. By so configuring the winding head, substantial savings in time and expense are achieved in repairing the winding head if there happens to be arcing between the winding head and coil during heat treating of the coil and testing of the coil for electrical continuity by passing a current therethrough.

12 Claims, 4 Drawing Sheets

WINDING HEAD FOR WIRE COILS

FIELD OF INVENTION

The present invention is directed to winding heads for wire coils. More particularly, the present invention is directed to winding heads being configured to facilitate repair of a coil winding machine.

BACKGROUND OF THE INVENTION

Coil winding machines such as Aumann winding machines are used to manufacture wire coils used in electrical circuits and generally index coils through four stations, including a winding station, a wire trimming station, a heat treating station and an unloading station. Before the coil is released at the unloading station, the coil is tested for electrical continuity. If a short is present, an electrical arc through the support arbor can occur ruining the winding head and forcing the replacement of the entire tool at a cost of about $10,000.00. Currently, the lead time for replacement of the entire tool is approximately six months, which means that it may be necessary for a manufacturing facility to have spare winding heads solely for the purpose of replacing heads which have been damaged by electrical arcing.

Accordingly, there is a need for or techniques to repair winding heads which do not require replacement of the entire tool.

SUMMARY OF THE INVENTION

It is a feature of the present invention to provide a new and improved winding head which can be rapidly repaired after being damaged by an electric arc occurring during testing of a coil on the winding head.

In view of this feature and other features, the present invention is directed to a portion of a winding head configured as a bobbin for receiving a strand of wire thereon in the form of a coil wound around the bobbin wherein the bobbin is mounted on a mandrel which is indexed to a plurality of stations by a coil winding machine. The bobbin comprises a cylindrical hub portion having a first end and a second end, the cylindrical hub portion defining a hollow cylindrical core adapted to receive the mandrel therein for supporting the bobbin thereon. The first end of the hub has a plurality of holes therethrough for receiving screws adapted to bolt the bobbin to the mandrel. The second end of the hub has surfaces extending radially therefrom and canted at a shallow angle to form a convex annular surface. The plurality of ribs on the hub extend from the first end of the hub to the second end. The ribs are separated by slots which extend through the first and second ends of the hub dividing the convex annular surface into a plurality of segments.

In a further aspect of the invention the bobbin is unitary and made of steel.

In still a further aspect of the invention, the bobbin is in combination with a mandrel having an end portion which projects into the hollow cylindrical core of the hub, the mandrel further having a radially extending shoulder with a surface canted at the same angle as the second end of the hub to form a concave annular surface facing the convex annular surface of the second end of the hub.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
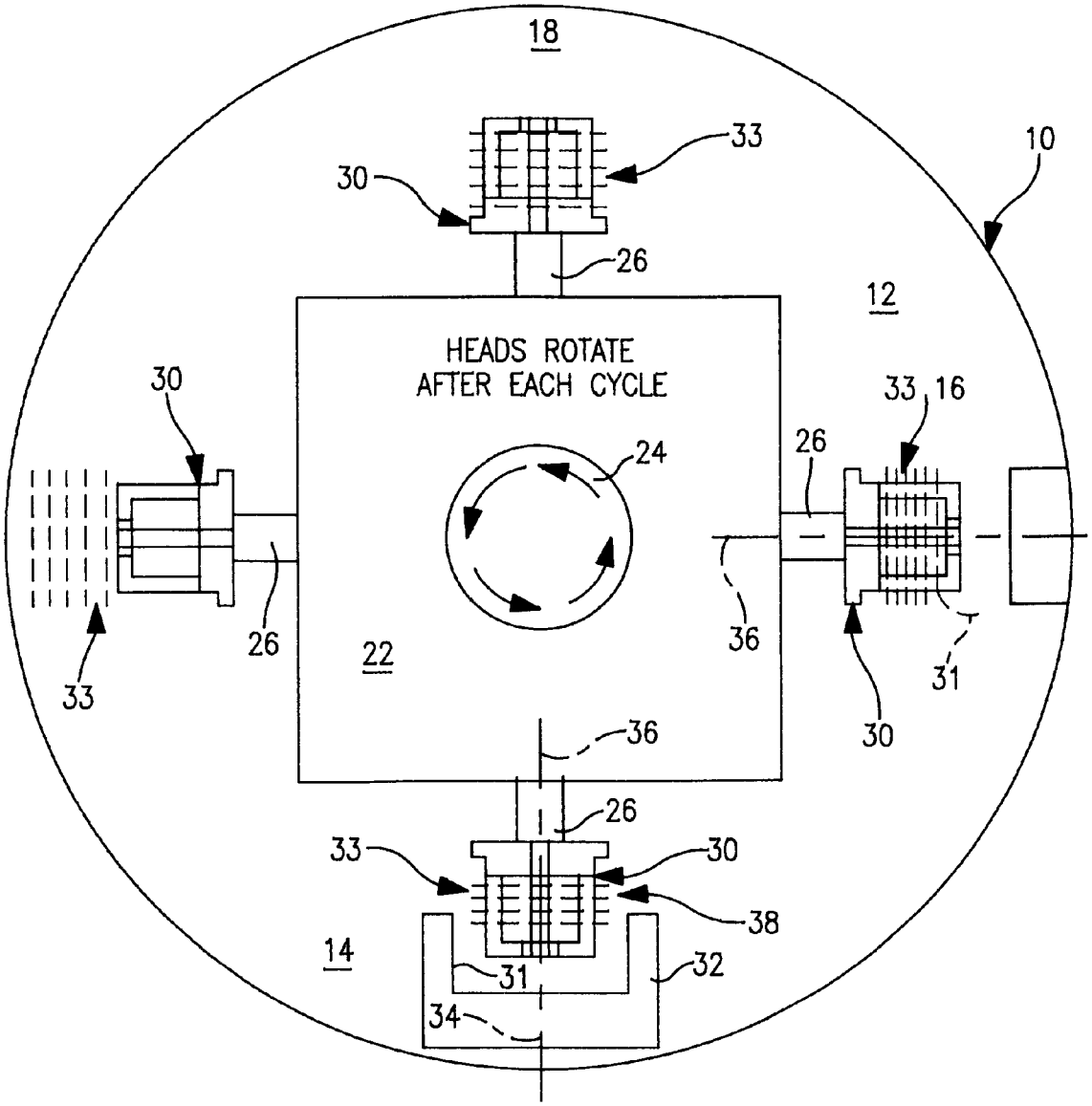
FIG. 1 is a planar end view of a portion of a coil winding machine showing arbors with bobbins mounted thereon in accordance with the principles of the present invention.

Referring now to FIG. 1, there is shown a coil winding machine 10 which includes a platform 12 that includes thereon a wire winding station 14, a wire trimming station 16, a heat treating station 18, and a coil unloading station 20. The coil winding machine 10 makes electrical coils of insulated wire and is a type of machine, exemplified by Aumann winding machines from Aumann corporation of Espelkapin, Germany, such as the Aumann Winding Machine Model L120. The coil winding machine 10 includes a turret 22 which rotates in the direction of arrows 24 to index four arbors 26 to the stations 14, 16, 18, and 20. The four arbors 26 each have a winding head 30 thereon configured in accordance with the principles of the present invention.

At the wire winding station 14, wire 31 is dispensed from a winder 32 which rotates about an axis 34 that is coaxial an axis 36 of the arbor 26 and winding head 30. The turret 22 then rotates the arbor 26 to align the arbor with a wire trimmer 38 which trims the wire 31 before the turret 22 indexes the arbor 26 and attached winding head 30 with the coil 33 thereon to the heat treating station 18. The wire 31 of the coil 33 is then heated by passing a current therethrough in order to both cure the insulation and to test the wire 31 for continuity. It is at the heat treating station 18 that arcing may occur if the insulation on the wire 31 is open. Since the winding head 30 must have a mirror finish, arcing can destroy the winding head.

After heat treating and continuity testing at station 18, the turret 22 rotates the arbor 26 to the unloading station 20 where the coil 33 is removed from the winding head 30.

Figure 2B:
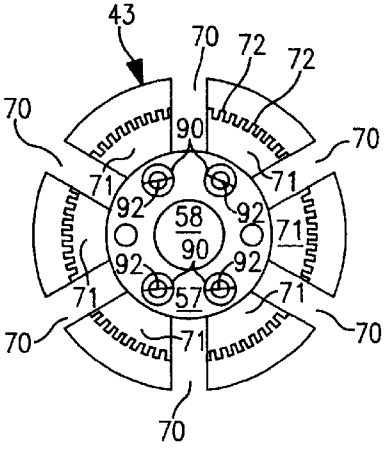
FIG. 2B is a front view showing the collar slid over the bobbin and mandrel of FIG. 2A.
Figure 2A:
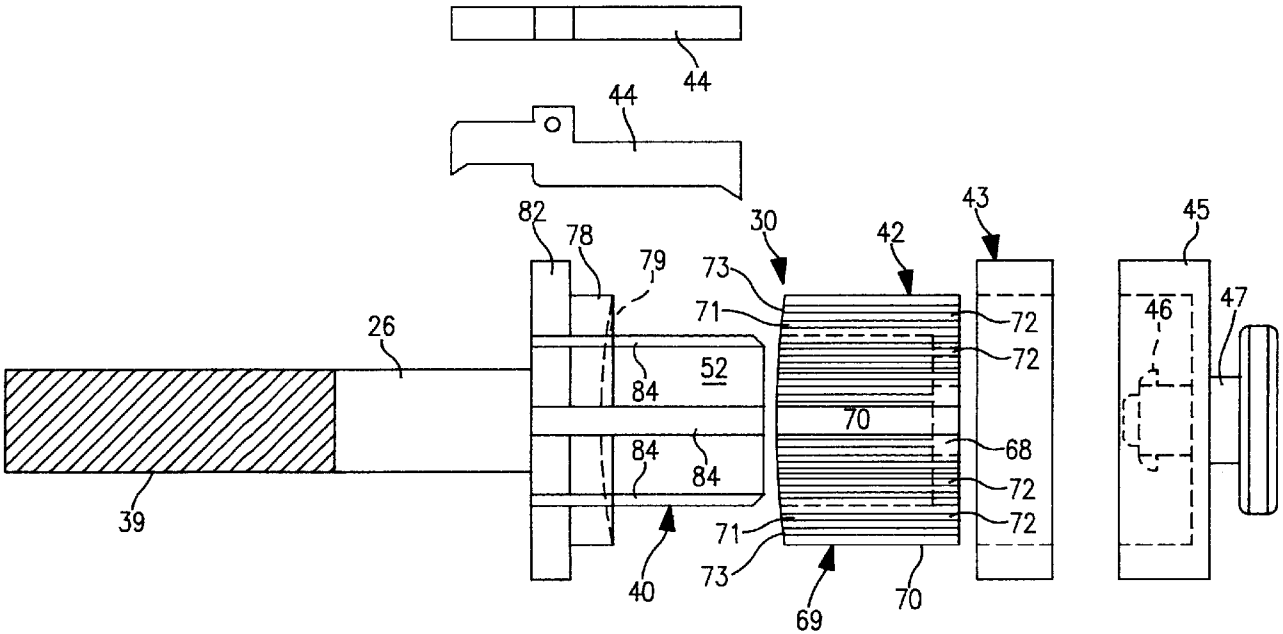
FIG. 2A is an exploded side view showing one of the arbors used with the coil winding machine of FIG. 1 as well as a bobbin, a collar, a cap and fingers, all of which are mounted on the arbor.
Figure 3:
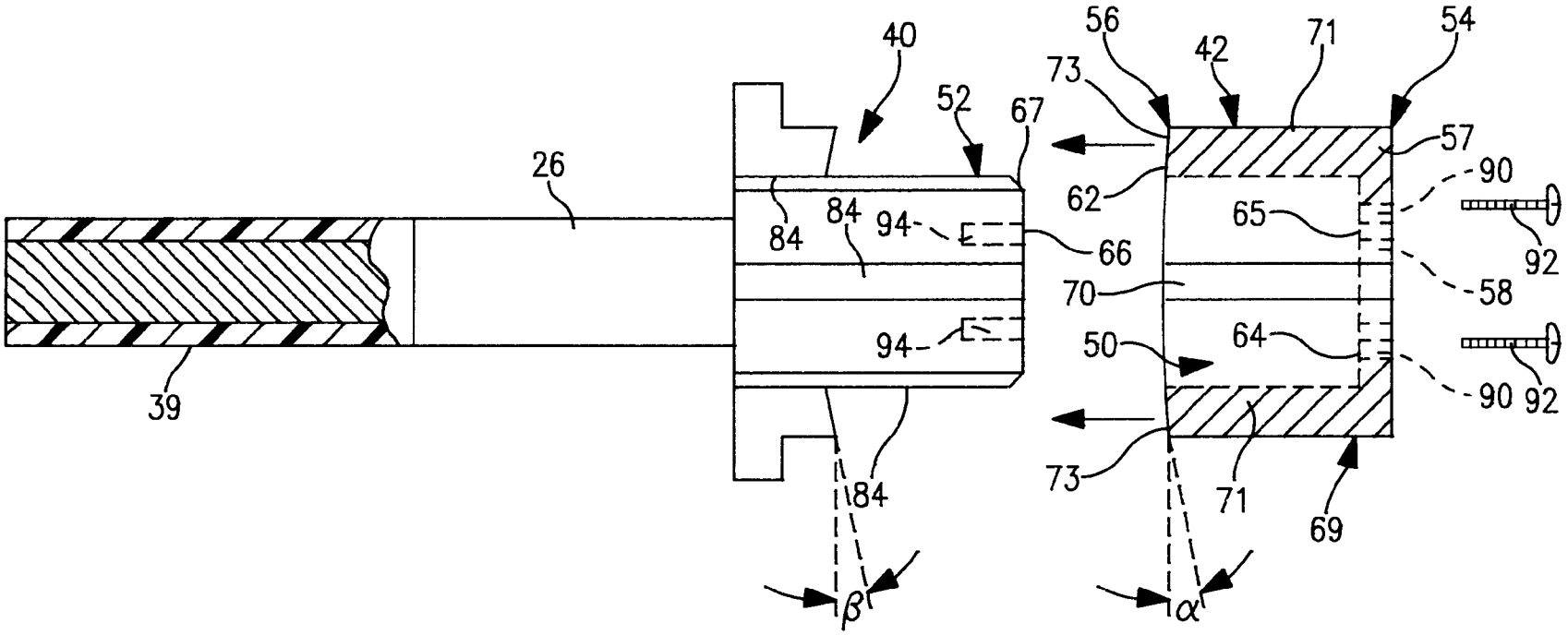
FIG. 3 is a side view showing only the arbor and only the mandrel and bobbin of the present invention with the bobbin and part of the arbor in elevation.
Figure 6:
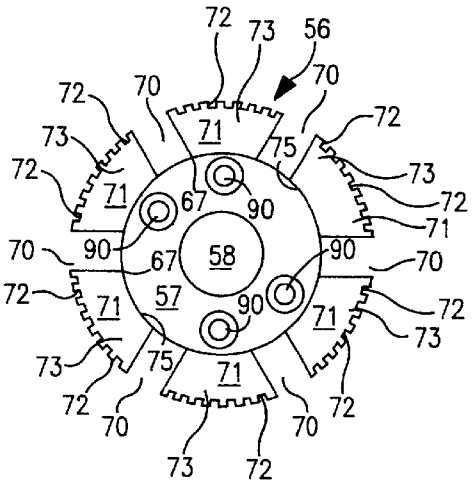
FIG. 6 is a rear end view of the bobbin of FIGS. 1–5.
Figure 5:
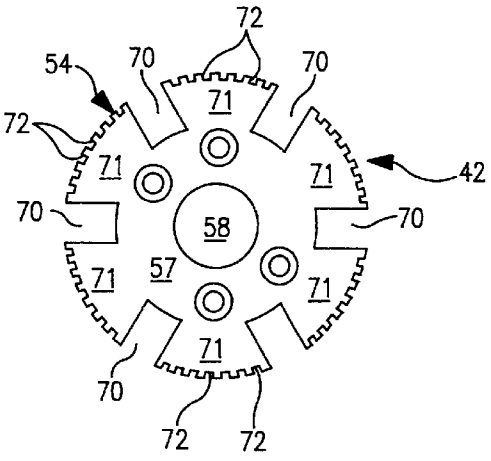
FIG. 5 is a front end view of the bobbin of FIGS. 1–4.
Figure 4:
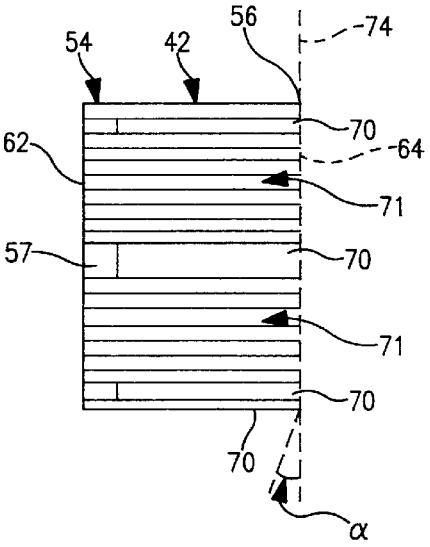
FIG. 4 is a side view of the bobbin shown in FIGS. 1–3.

Referring now to FIGS. 2A and 2B where one of the arbors 26 is shown isolated from the turret 22, it is seen that the arbor has one end portion 39 which is insulated and one end portion configured as a mandrel 40. The mandrel 40 receives a bobbin 42 thereon which in combination therewith forms the winding head 30 shown in FIG. 1. By dividing the winding head 30 into two portions (the mandrel 40 and bobbin 42), repair of the coil winding machine 10 after damage by arcing is substantially facilitated since all that is required is to remove the damaged bobbin and replace it with a new bobbin. Prior to the present invention, it was necessary to order a new arbor 26 to replace the damaged arbor. This cost in the neighborhood of $ 10,000.00 and took six months. The damaged arbors 26 were thrown into a closet. The damaged arbors 26 are now re-machined to form arbors with mandrels 40 and bobbins 42 are machined for placement on the mandrels. Machining a new bobbin 42, as is done with the present invention, costs about $1,000.00 and requires no more than two weeks. Clearly, the savings are considerable.

As with the prior art arrangement, a collar 43 slides back over the mandrel 40 and bobbin 42 to retain an end of the wire 31 thereon at the start of the winding of the coil 33. Additionally, as with the prior art arrangement, the coil 33 is wound over fingers 44 which are pivoted in slots within the bobbin 42 in order to facilitate removal of the coil from the head 30 at unloading station 20 after removing a cap 45 that is latched to the end of the bobbin by latching detents 46 which are retracted by a knob 47.

As is seen in FIGS. 3–6 in combination with FIG. 2, the bobbin 42 is a body having a cylindrical cavity 50 which receives a cylindrical projecting portion 52 extending from the mandrel 40. The bobbin 42 has first end 54 and a second end 56. The first end 54 is in the form of an annular hub 57 which defines a central aperture 58 that receives the latching detents 46 of the cap 45. The annular hub 57 of the bobbin 42 also includes an outwardly facing annular surface 62 and an interior annular surface 64, the interior annular surface 64 having a raised annular ridge 65 adjacent the opening 58. The end face 66 of the projection 52 has a slightly beveled edge 67 so as to facilitate insertion of the projection 52 into the cavity 50 of the bobbin 42.

The annular hub 57 of the bobbin 42 has a slotted portion 69 extending therefrom which is divided by slots 70 into six wedge-shaped segments 71 which are, in effect, cantilevered on the annular hub 57. The segments 71 each have a plurality of small longitudinally extending grooves 72 which reduce friction between the coil 33 and the surface of the bobbin 42 making it easier to dislodge the coil from the surface of the bobbin.

At the second end 56 of the bobbin 42, each of the six segments 71 has an angled face 73 which is disposed at an angle $\alpha$ of about 4.50° with respect to the radial plane 74 that is normal to the axis 36 of the winding head assembly 30 and, thus, to the bobbin 42. While the angle $\alpha$ is preferably 4.50°, the angle a may range from about 2° to about 7°. The inner edge 75 of each of the annular surfaces 73 is slightly rounded by a small radius of, for example, 0.04" so as to facilitate initially sliding the end 66 of the projection 52 into the cavity 50 of the bobbin 42.

While the outer diameter of the projection 52 is quite close to the inner diameter of the cavity 50, it is still necessary to ensure a tight fit between the bobbin 42 and mandrel 40 since the segments 71 are cantilevered. This is accomplished by having a radially extending shoulder 78 on the mandrel 40 which has a concave surface 79 that is at a preferable angle $\beta$ of about 5.00° so that when the surface 79 is in contact with the angled faces 73 of the bobbin 42, the cantilevered segments 71 are cammed radially inward into a tight fit on the projection 52. The angle $\beta$ of about 5.00° is a preferred angle because it is an angle which can be machined without undue difficulty when machining the concave surface 79 of the mandrel 40. While other angles $\beta$ may be used if there is a change in the angle $\alpha$ from 4.50°, it has been found that for an angle $\alpha$ of 4.50°, an angle $\beta$ of 5.00° accomplishes the tight fit between the bobbin 42 and mandrel 40 which is desired for a stable configuration. By having the angle $\beta$ exceed the angle $\alpha$ by about 0.50°, a tight fit between the bobbin 42 and mandrel 40 is achieved. Behind the shoulder 78 is a thick flange 82 against which the collar 43 abuts to facilitate winding the coil 33 (FIG. 1) on the bobbin 42 by holding an end of the wire 31.

Since the fingers 44 which are retracted to release the coil 33 are pivoted with respect to the arbor 26, the fingers are received in slots 84 found in the surface of the mandrel 40 at the location of the projection 52. The slots 84 align with the slots 70 in the bobbin 42 so that the fingers 44 extend longitudinally in both the bobbin and projection 52 and pivot outwardly beyond the surface of the bobbin in the manner of the aforementioned Aumann Winding Machine Model L120.

The front hub portion 68 of the bobbin 42 includes four smooth holes 90, each of which receives a screw 92 which is threaded into threaded bores 94 through the end face 66 of the mandrel 40. Consequently, the bobbin 42 is held tightly and non-rotatably on the mandrel 40 with the slots 70 in the bobbin radially aligned with the slots 84 in the projection 52.

If the bobbin 42 is damaged by arcing, it is easily removed from the coil machine 10 by unscrewing the screws 92 and pulling the bobbin longitudinally off of the mandrel. A new bobbin 42 is then machined and slid onto the mandrel 40.

From the foregoing description, one skilled in the art can easily ascertain the essential characteristics of this invention, and without departing from the spirit and scope thereof, can make various changes and modifications of the invention to adapt it to various usages and conditions.

We claim:

1. A bobbin for receiving a strand of wire thereon in the form of a coil around the bobbin, the bobbin being mounted on a mandrel which is indexed to a plurality of stations by a coil winding machine, the bobbin comprising:

a generally cylindrical body having a first end and a second end;

the first end of the body having a hub adapted for fixed attachment to the mandrel;

a plurality of radially extending segments separated by slots, the segments extending axially from the hub and defining a cavity in the body;

each segment having an end face at the second end of the body which is canted at a slight convex angle, wherein as the hub is urged against the mandrel as the mandrel is inserted into the cavity, the end faces of the segments are urged radially inward against the mandrel by a concave surface on the mandrel.

2. The bobbin of claim 1, wherein the segments each have axially extending grooves to facilitate removal of the coil from the bobbin by reducing the surface contact area therebetween.

3. The bobbin of claim 2, wherein the bobbin is unitary.

4. The bobbin of claim 3, wherein the hub is annular with a circular opening therethrough and wherein the hub includes a plurality of unthreaded holes therethrough for receiving screws adapted to thread into threaded axial bores in the mandrel.

5. The bobbin of claim 1, wherein the end face of each segment is canted about4.50°.

6. In combination on a coil winding machine in which a coil of wire is wound and indexed to a plurality of stations by the coil winding machine, the combination comprising:

a bobbin on which the coil is wound, the bobbin comprising:

a generally cylindrical body having a first end and a second end;

the first end of the body having a hub adapted for fixed attachment to the mandrel;

a plurality of radially extending segments separated by slots, the segments extending axially from the hub and defining a cavity in the body;

each segment having an end face at the second end of the body which is canted at a slight convex angle and as the mandrel is inserted into the cavity, the end faces of the segments are urged radially inward against the mandrel by a convex surface on the mandrel;

a mandrel for supporting the bobbin, the mandrel comprising:

a projecting portion received into the cavity in the body of the bobbin and a radially extending shoulder with a concave end face for abutting end faces of the segments of the bobbin to cam the segments into tight engagement with the projecting portion of the mandrel.

7. The combination of claim 6, wherein the segments each have axially extending grooves to facilitate removal of the coil from the bobbin by reducing the surface contact area therebetween.

8. The combination of claim 6, wherein the bobbin is unitary.

9. The combination of claim 6, wherein the hub is annular with a circular opening therethrough and wherein the hub includes a plurality of unthreaded holes therethrough for receiving screws adapted to thread into threaded axial bores in the mandrel.

10. The combination of claim 9, wherein the projecting portion of the mandrel has a plurality of slots therein which are aligned with the slots in the bobbin and wherein fingers disposed in the slots in the projecting portion and pivoted in the mandrel extend through the slots in the bobbin to releasably support the coil of wire being wound on the bobbins.

11. The combination of claim 6, wherein the slight angle at which each end face of the segments is canted is at an angle $\alpha$ of about 4.50° and wherein the concave end face of the shoulder on the mandrel is at an angle $\beta$ of about 5.00°.

12. The combination of claim 6, wherein the difference between the angle of the end face of each segment and the angle of the concave end face is about 0.5°.

* * * * *